US012253322B1

(12) United States Patent
Vining

(10) Patent No.: US 12,253,322 B1
(45) Date of Patent: Mar. 18, 2025

(54) MUZZLE DEVICE CLAMPING MECHANISM

(71) Applicant: JA IP Holding, LLC, Morgan City, LA (US)

(72) Inventor: Ryan Vining, Patterson, LA (US)

(73) Assignee: JA IP HOLDING, LLC, Morgan City, LA (US)

( * ) Notice: Subject to any disclaimer, the term of this patent is extended or adjusted under 35 U.S.C. 154(b) by 0 days.

(21) Appl. No.: 18/374,243

(22) Filed: Sep. 28, 2023

Related U.S. Application Data

(60) Provisional application No. 63/410,661, filed on Sep. 28, 2022.

(51) Int. Cl.
*F41A 21/32* (2006.01)
*F41A 21/36* (2006.01)

(52) U.S. Cl.
CPC ..... *F41A 21/325* (2013.01); *F41A 21/36* (2013.01)

(58) Field of Classification Search
CPC ..... F41A 21/325; F41A 21/36; F41A 21/484; F41A 21/487; F16B 2/16
See application file for complete search history.

(56) References Cited

U.S. PATENT DOCUMENTS 3,455,586 A * 7/1969 Kurtzmann ..... F16D 1/0847 403/372
4,229,059 A * 10/1980 Dever ..... F16C 23/084 384/541
4,403,814 A * 9/1983 Koss ..... F16D 1/0847 384/541
4,944,213 A * 7/1990 Ewert ..... F41A 21/325 89/14.3
5,559,302 A * 9/1996 Latka ..... F41A 21/325 89/14.05
6,887,189 B2 5/2005 Schiff
7,610,710 B2 * 11/2009 Brittingham ..... F41A 21/325 89/14.4
8,701,326 B2 * 4/2014 Zonshine ..... F41A 21/482 89/14.05
10,180,300 B2 1/2019 Schirmer
10,234,237 B1 * 3/2019 Jager ..... F41A 21/36
10,337,820 B2 7/2019 Jager
(Continued)

FOREIGN PATENT DOCUMENTS

DE 3624167 A1 * 3/1987
DE 10213292 A1 * 10/2003 ..... F41A 21/00
EP 1930684 A1 * 6/2008 ..... F41A 21/30

*Primary Examiner* — Gabriel J. Klein
(74) *Attorney, Agent, or Firm* — Asgaard Patent Services, LLC; F. Wayne Thompson, Jr.

(57) ABSTRACT

Disclosed is a muzzle device that includes a clamping mechanism used to removably attach the muzzle device to the muzzle of a firearm barrel. In particular, the clamping mechanism eliminates the need of using threads on the muzzle of the firearm barrel when removably attaching the muzzle device. An example muzzle device has a structural body and a clamping mechanism. The structural body includes a first end that has a muzzle receiving aperture configured to fit about the muzzle of the firearm barrel and a second end that has a projectile aperture sized to allow passage of a projectile exiting the muzzle of the firearm barrel. The clamping mechanism is configured to allow for both linear and axial positioning of the muzzle device on the muzzle of the firearm barrel.

17 Claims, 8 Drawing Sheets

(56) References Cited

U.S. PATENT DOCUMENTS

| | | | | |
|---|---|---|---|---|
| 10,386,147 | B1 | 8/2019 | Fan | |
| 10,731,939 | B2 | 8/2020 | Na et al. | |
| 10,767,952 | B1 * | 9/2020 | Till | F41A 21/325 |
| 2006/0291764 | A1 * | 12/2006 | Ravindra | F16C 35/063 384/541 |
| 2007/0292067 | A1 * | 12/2007 | Ravindra | F16D 1/0847 384/541 |
| 2010/0154278 | A1 * | 6/2010 | Curry | F41A 21/36 42/107 |
| 2014/0075800 | A1 * | 3/2014 | Morris, Jr. | F41A 21/36 42/1.06 |
| 2015/0253098 | A1 * | 9/2015 | Russell | F41A 21/30 89/14.4 |
| 2017/0205178 | A1 * | 7/2017 | Niswander | F41A 21/325 |
| 2019/0154388 | A1 * | 5/2019 | Jager | F41G 1/02 |
| 2021/0231407 | A1 * | 7/2021 | Salinas | F41G 11/00 |
| 2022/0404112 | A1 * | 12/2022 | Davis | F41A 21/325 |
| 2023/0090595 | A1 * | 3/2023 | Underwood | F41A 21/36 89/14.3 |
| 2023/0228515 | A1 * | 7/2023 | Roe | F41A 21/325 89/14.05 |
| 2023/0266089 | A1 * | 8/2023 | Krnezic | F41A 21/325 89/14.3 |
| 2023/0358496 | A1 * | 11/2023 | Zaffiri | F41A 21/325 |
| 2024/0110758 | A1 * | 4/2024 | Roe | F41A 21/325 |
| 2024/0191960 | A1 * | 6/2024 | Toner | F41A 21/36 |
| 2024/0240900 | A1 * | 7/2024 | Shaw | F41A 21/325 |

* cited by examiner

MUZZLE DEVICE CLAMPING MECHANISM

CROSS-REFERENCE TO RELATED APPLICATION(S)

This application claims the benefit of U.S. Provisional Application Ser. No. 63/410,661, filed on Sep. 28, 2022, the entirety of which is incorporated herein by reference.

TECHNICAL FIELD

This disclosure relates to a clamping mechanism used to secure a muzzle device, such as a compensator, to the barrel of a firearm.

BACKGROUND

Muzzle devices such as compensators, flash suppressors, and muzzle brakes are often used to improve user performance with a firearm. These devices serve various purposes, including reducing recoil, managing muzzle rise, and mitigating the effects of muzzle flash. However, the attachment of such devices to the barrels of firearms has presented challenges.

Attaching a muzzle device to a firearm's barrel typically relies on threaded connections. A muzzle device is threaded onto matching threads on the barrel's muzzle end. While this approach is widely accepted and used, it has inherent drawbacks that limit its effectiveness and versatility.

One significant challenge is achieving precise alignment of the muzzle device on the muzzle end of the barrel. Achieving precise alignment is crucial to ensure the proper function of many muzzle devices. Threaded attachment methods often struggle to maintain alignment, as even minor inconsistencies in threading or manufacturing tolerances can lead to misalignment issues. These misalignment issues can result in decreased function and overall firearm performance.

Additionally, threaded muzzle devices can be challenging to install, particularly for firearm owners who lack the necessary tools or expertise. Over-tightening or under-tightening a threaded muzzle device can lead to issues such as stripped threads or a loose fit, both of which can have adverse effects on the firearm's function and safety.

Accordingly, needs exist for the muzzle device clamping mechanism disclosed herein. It is to the provision of a muzzle device clamping mechanism configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a muzzle device that includes a clamping mechanism for removably attaching the muzzle device to the muzzle of a firearm barrel. In particular, the clamping mechanism eliminates the need for threads on the muzzle of the firearm barrel when removably attaching the muzzle device.

An example muzzle device comprises a structural body and a clamping mechanism. The structural body includes a first end that has a muzzle-receiving aperture configured to fit about the muzzle of the firearm barrel, and a second end that has a projectile aperture sized to allow the passage of a projectile exiting the muzzle of the firearm barrel. The clamping mechanism includes at least one dowel pin nested within a longitudinally extending groove in the muzzle-receiving aperture of the structural body, and a threaded fastener used to press the at least one dowel pin against the muzzle of the firearm barrel. The clamping mechanism is configured to allow both linear and axial positioning of the muzzle device on the muzzle of the firearm barrel.

Another example muzzle device comprises a structural body, a thread protector, and a clamping mechanism. The structural body includes a first end that has a muzzle-receiving aperture configured to fit about the muzzle of the firearm barrel, and a second end that has a projectile aperture sized to allow the passage of a projectile exiting the muzzle of the firearm barrel. The thread protector has a groove in the exterior of its lateral surface. The thread protector is configured to fit within the muzzle-receiving aperture of the structural body, and for attachment to the muzzle of the firearm barrel. The clamping mechanism includes at least one dowel pin nested within a longitudinally extending groove in the muzzle-receiving aperture of the structural body, and a threaded fastener used to press the at least one dowel pin into the groove of the thread protector. The groove of the thread protector is configured to serve as a mating interface for the clamping mechanism. The clamping mechanism is configured to allow both linear and axial positioning of the muzzle device on the thread protector. In some implementations, the clamping mechanism comprises at least one dowel pin and a threaded fastener. The dowel pin is nested within a longitudinally extending groove in the muzzle receiving aperture of the structural body and the threaded fastener is used to press the at least one dowel pin against the muzzle of the firearm barrel.

BRIEF DESCRIPTION OF THE DRAWINGS

Like reference numerals refer to corresponding parts throughout the several views of the drawings.

DETAILED DESCRIPTION

FIGS. 1-7 illustrate a muzzle device 100 according to the principles of the present disclosure. The muzzle device 100 shown in the illustrations is a compensator, sometimes referred to as a muzzle brake, configured to redirect a portion of propellant gasses to counter recoil and muzzle rise. The muzzle device 100 includes an example clamping mechanism 130 used to removably attach the muzzle device 100 to the muzzle of a firearm barrel 104. In particular, the clamping mechanism 130 eliminates the need of using threads on the muzzle 102 of the firearm barrel 104 when attaching the muzzle device 100.

Figure 1:
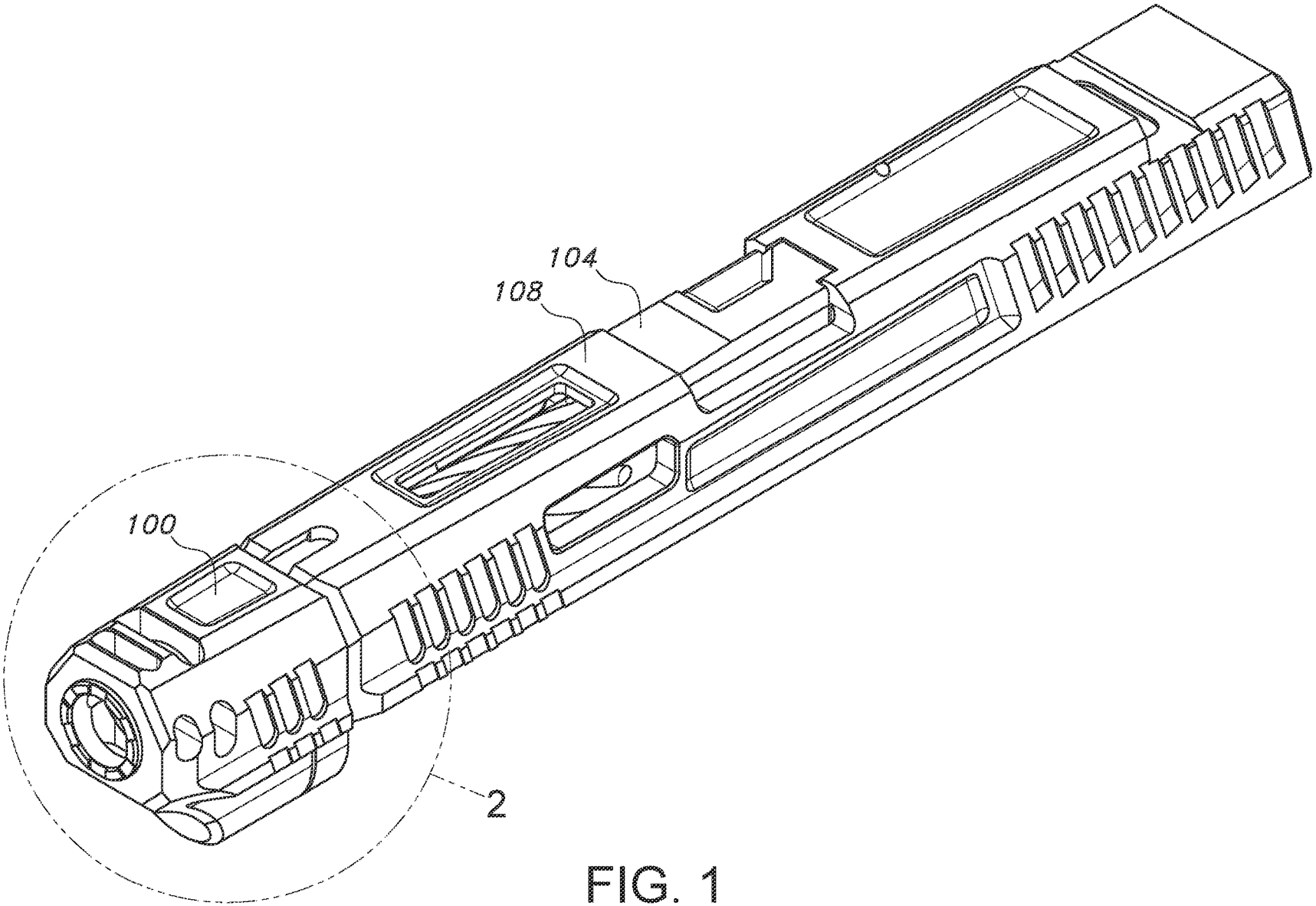
FIG. 1 is an isometric view of a pistol slide assembly that has a muzzle device according to the principles of the present disclosure attached to the muzzle of the barrel.
Figure 2:
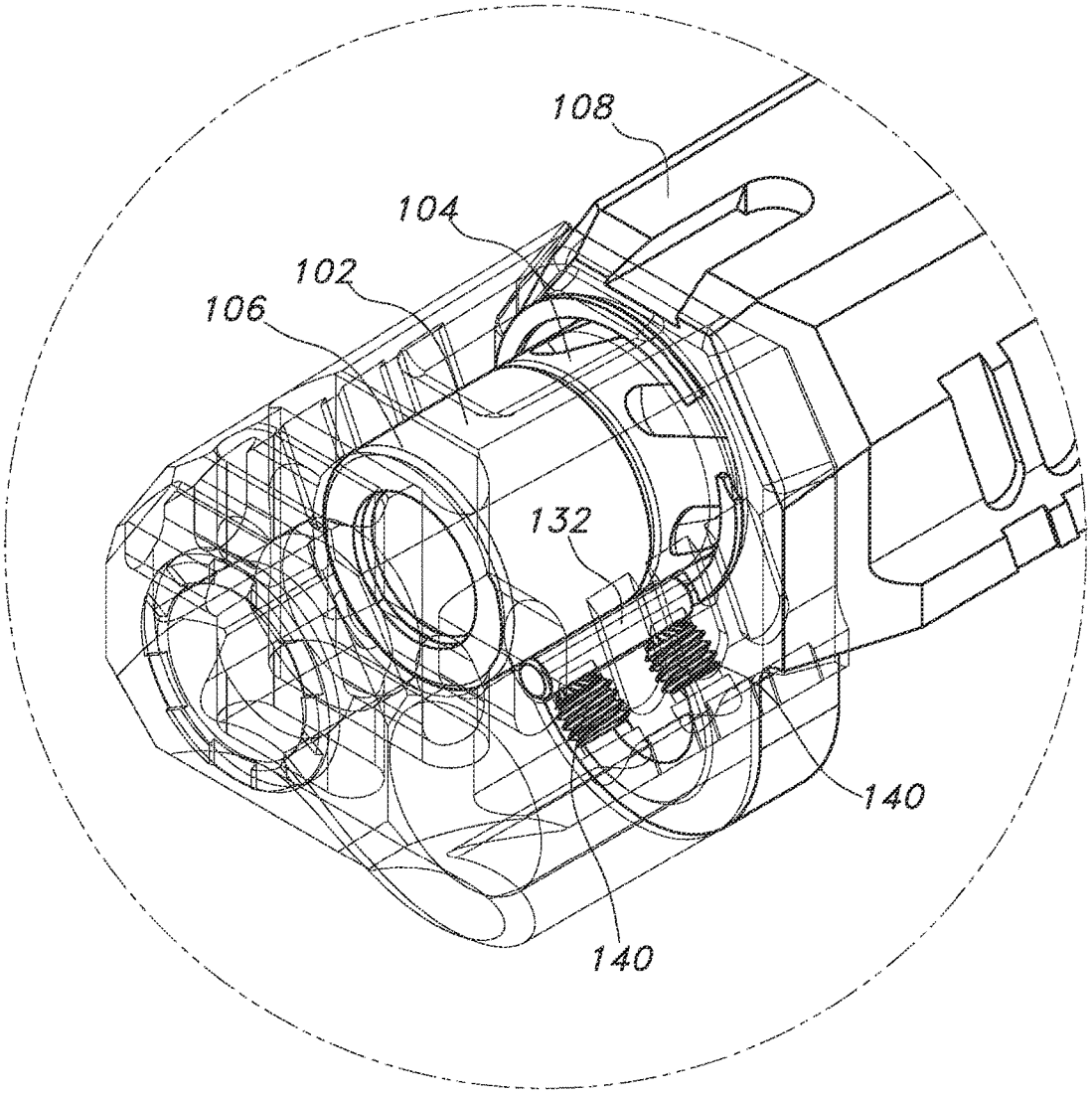
FIG. 2 is an enlarged view of the indicated area of detail in FIG. 1, in which the muzzle device is transparent.

As shown in FIG. 2, a thread protector 106, well known to those of ordinary skill in the art, is secured to the muzzle 102 of the firearm barrel 104. The thread protector 106 has the same outside diameter (OD) as the non-threaded portion of the firearm barrel 104 adjacent to the thread protector 106. While the example firearm barrel 104 has a threaded muzzle 102 which necessitates the use of the thread protector 106, the clamping mechanism 130 can be used to secure the muzzle device 100 to a firearm barrel that has a non-threaded muzzle.

As shown in FIGS. 1-7, the muzzle device 100 comprises a structural body 110 and a clamping mechanism 130.

Figure 3:
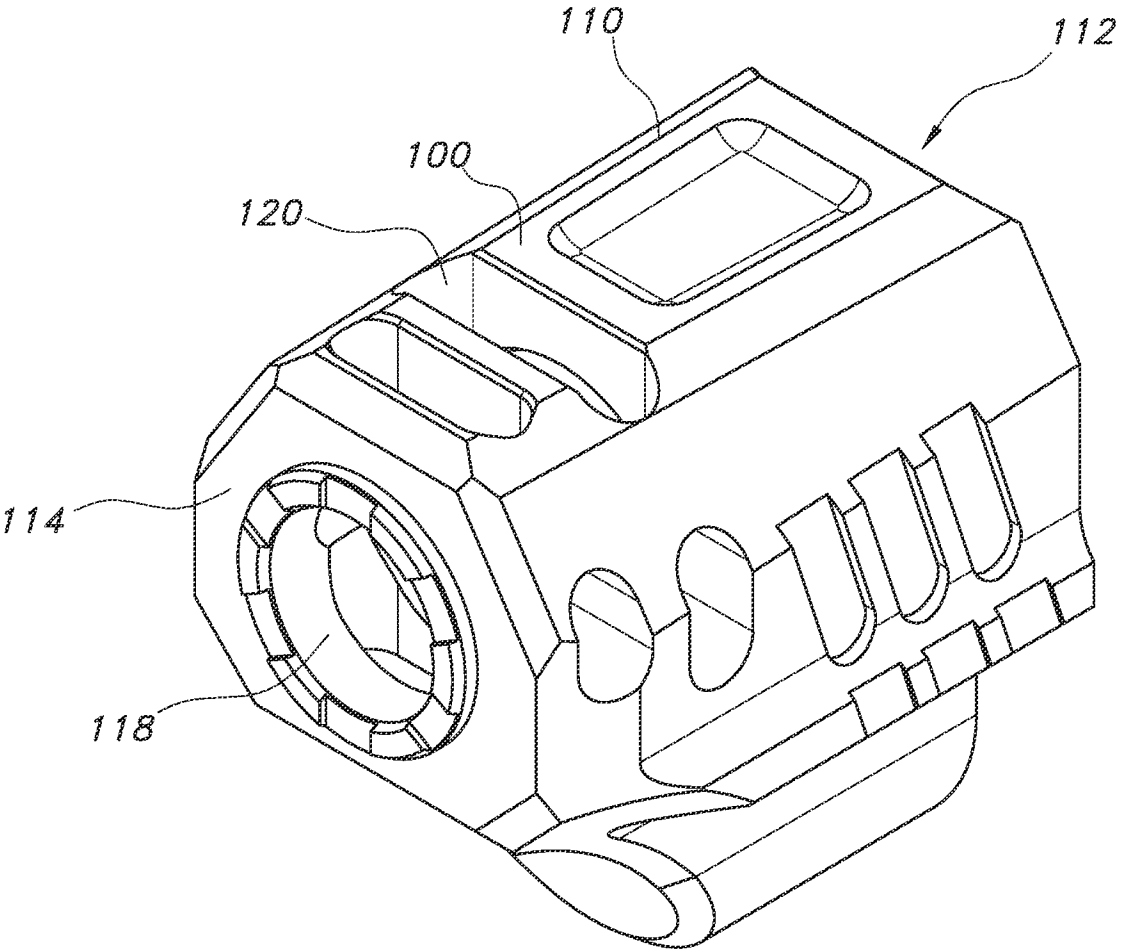
FIG. 3 is an isometric view of the muzzle device shown in FIG. 1.
Figure 5:
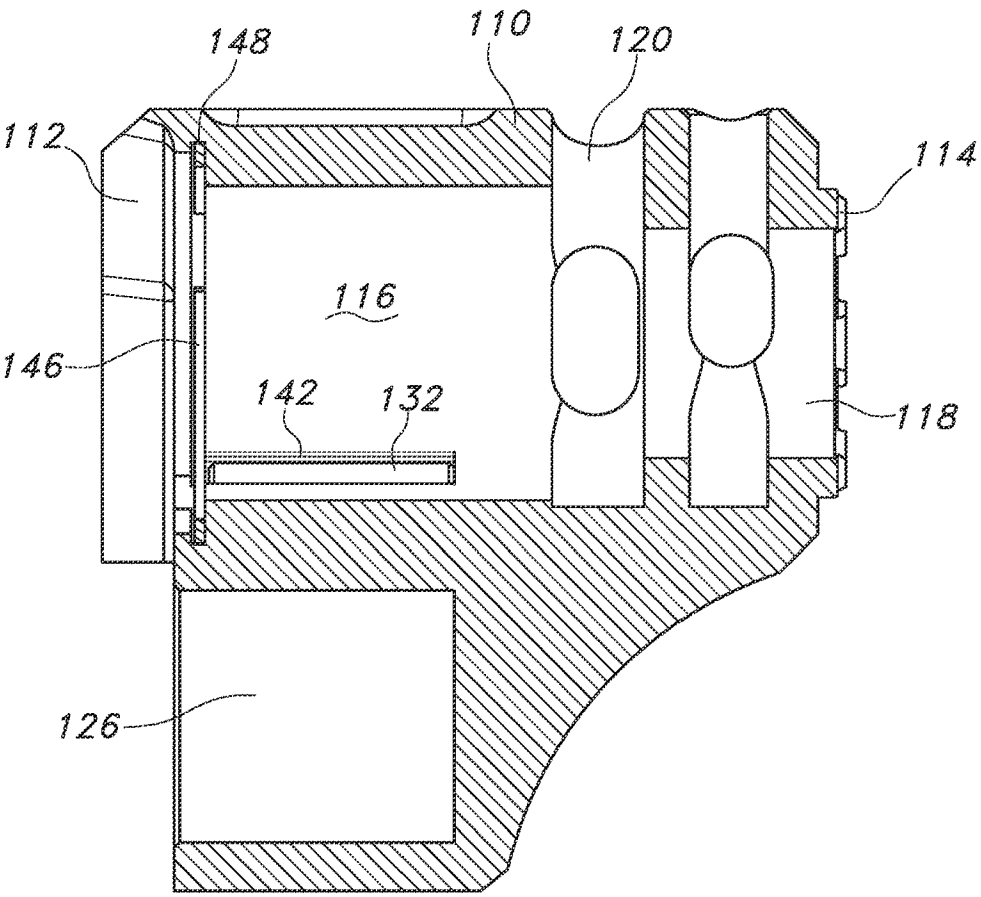
FIG. 5 is a side cutaway view of the muzzle device taken along lines 5-5 shown in FIG. 4.
Figure 4:
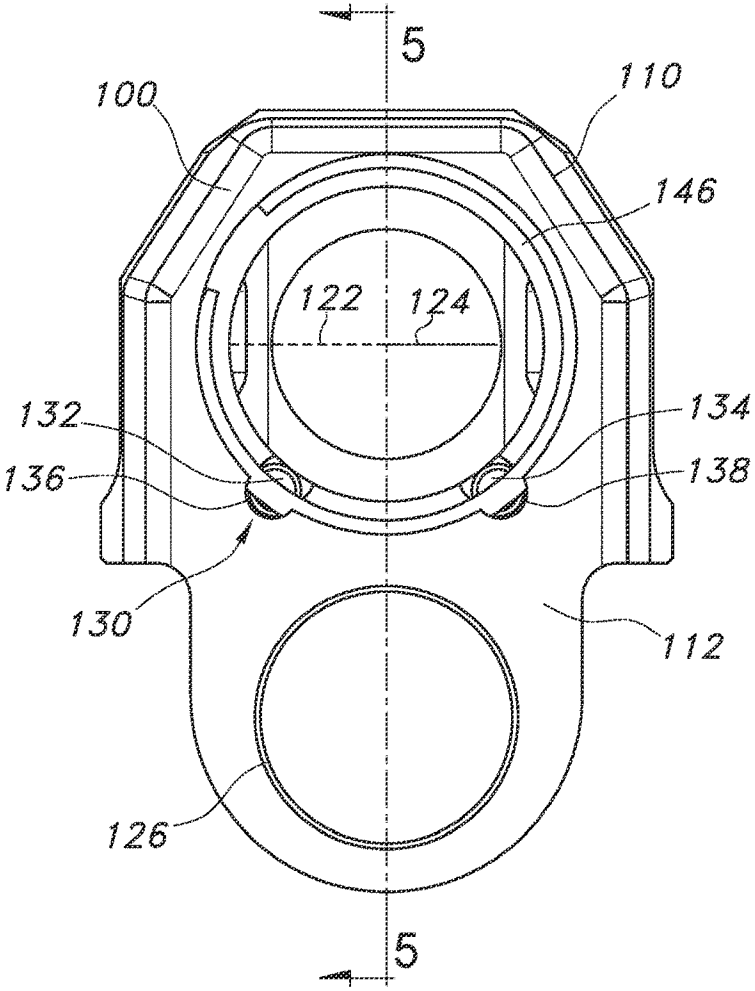
FIG. 4 is a rear plan view of the muzzle device shown in FIG. 3.

As shown in FIGS. 3-5, the structural body 110 of the muzzle device 100 has a first end 112 (or muzzle end) and a second end 114 (or exit end). The length of the structural body 110, a distance from the first end 112 to the second end 114, can vary in different implementations of the muzzle device 100. For example, the length of the structural body 110 can depend on the caliber of firearm the muzzle device 100 is being used on. The first end 112 of the structural body 110 includes a muzzle receiving aperture 116 and the second end 114 of the structural body 110 includes a projectile aperture 118. The muzzle receiving aperture 116 is configured to fit about the muzzle 102 of the firearm barrel 104. More specifically, a radius 122 of the muzzle receiving aperture 116 is selected to provide for a slip-fit tolerance between the muzzle receiving aperture 116 and the muzzle 102 of the firearm barrel 104. The projectile aperture 118 in the exit end 114 is sized to allow passage of a projectile exiting the muzzle 102 of the firearm barrel 104. The projectile aperture 118 is also long enough to intersect the muzzle receiving aperture 116 and sufficiently aligned with the muzzle receiving aperture 116 to allow passage of a projectile exiting the muzzle 102 of the firearm barrel 104 (see, e.g., FIG. 5). The radius 122 of the muzzle receiving aperture 116 is greater than a radius 124 of the projectile aperture 118.

The first end 112 of the structural body 110 also includes a guide rod receiving bore 126 that is positioned below, and parallel with, the muzzle receiving aperture 116. The guide rod receiving bore 126 is sized and positioned to receive the portion of a guide rod that extends from the slide 108 during the slide movement cycle. In this way, the muzzle device 100 can be positioned adjacent to the face of the slide 108 without disrupting its cycle of operation.

The structural body 110 of the muzzle device 100 also has at least one gas discharge vent 120 used to divert combustion gases away from the muzzle 102 of the firearm barrel 104. The at least one gas discharge vent 120 extends through the structural body 110 of the muzzle device 100 perpendicular to the projectile aperture 118. In this way, the at least one gas discharge vent 120 is in fluid communication with the projectile aperture 118. For effective muzzle rise reduction, the at least one gas discharge vent 120 extends through a top surface of the structural body 110 of the muzzle device 100 (see, e.g., FIG. 3). The positioning of the at least one gas discharge vent 120 mitigates the muzzle rise by exerting a force equal in magnitude and opposite in direction. Even though the muzzle device 100 is described with at least one gas discharge vent 120, preferably, the muzzle device 100 will utilize additional gas discharge vents as shown in FIG. 3.

The clamping mechanism 130 of the muzzle device 100 is an anti-rotation clamping mechanism that allows for precise linear and axial positioning of the muzzle device 100 on the muzzle 102 of the firearm barrel 104. The clamping mechanism 130 comprises two dowel pins (132, 134) that are nested within separate longitudinally extending grooves (136, 138) in the muzzle receiving aperture 116 of the structural body 110 (see, e.g., FIG. 7). The longitudinally extending grooves (136, 138) are parallel, and circumferentially offset from each other (see, e.g., FIG. 4). At least one threaded fastener 140 is used to press each dowel pin (132, 134) against the muzzle 102 of the firearm barrel 104, thereby clamping the muzzle device 100 to the muzzle 102 of the firearm barrel 104. It should be noted that, the dowel pins (132, 134) of the clamping mechanism 130 facilitate attachment of the muzzle device 100 to a cylindrical surface, such as the firearm barrel 104. This allows for precise linear and axial positioning of the muzzle device 100 on the muzzle 102 of the firearm barrel 104, relative to the slide 108.

Each dowel pin (132, 134) is a cylindrical pin having an outside diameter that is greater than the width of the longitudinal exit opening (142, 144) defined by each longitudinally extending groove (136, 138) in the muzzle receiving aperture 116 of the structural body 110. In this way, a dowel pin (132, 134) is prevented from being pushed out of the longitudinally extending groove (136, 138) by the threaded fastener (140). Each dowel pin (132, 134) is inserted into a longitudinally extending groove (136, 138) through an opening in the first end 112 of the muzzle device 100.

As shown in FIG. 4, a retaining ring 146 is used to capture the dowel pins 132, 134 within their respective longitudinally extending grooves (136, 138). The retaining ring 146 is a spiral retaining ring positioned within a circumferential groove 148 positioned about the entrance of the muzzle receiving aperture 116 (see, e.g., FIG. 5).

Figure 6:
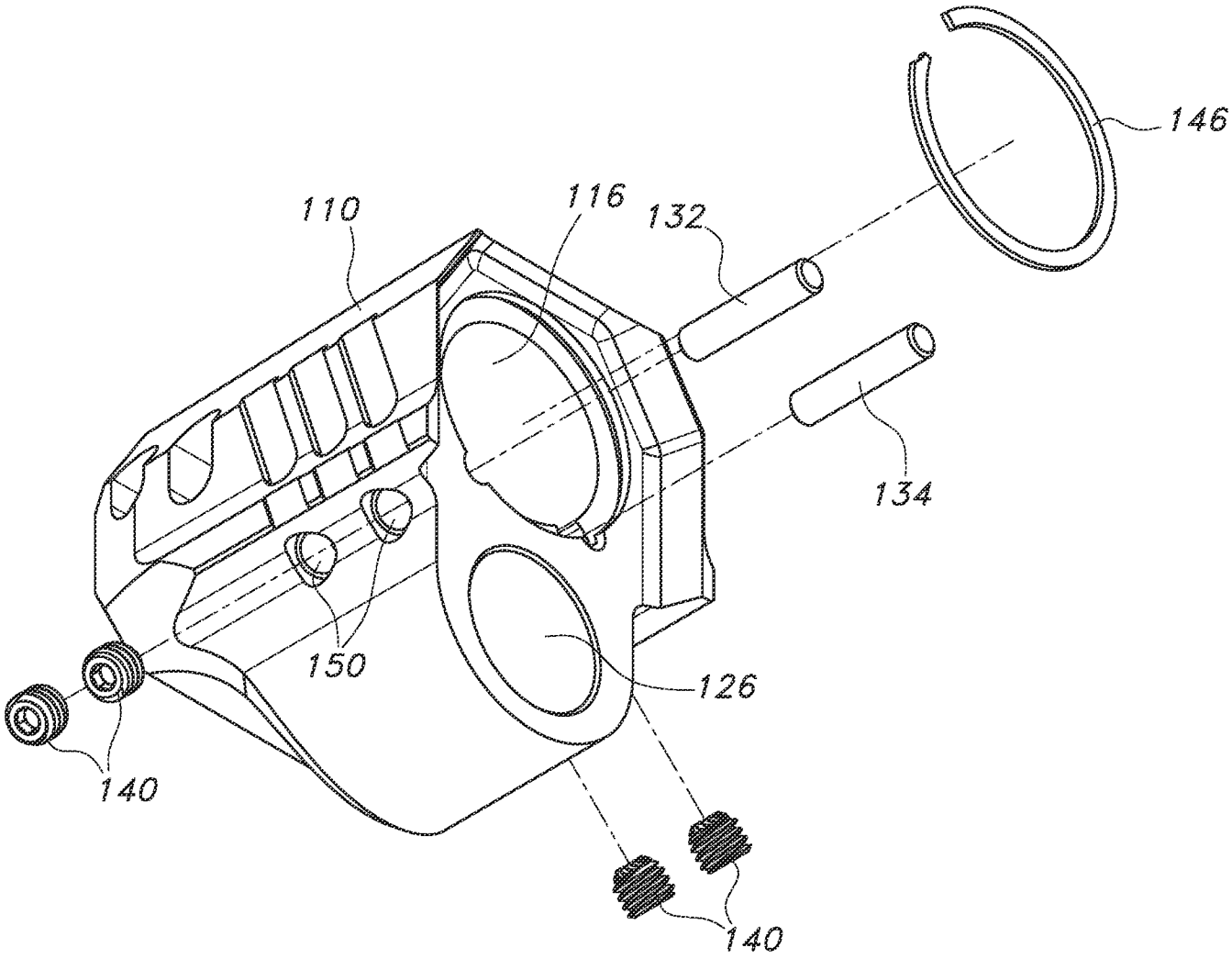
FIG. 6 is an exploded isometric view of the muzzle device shown in FIG. 3.
Figure 7:
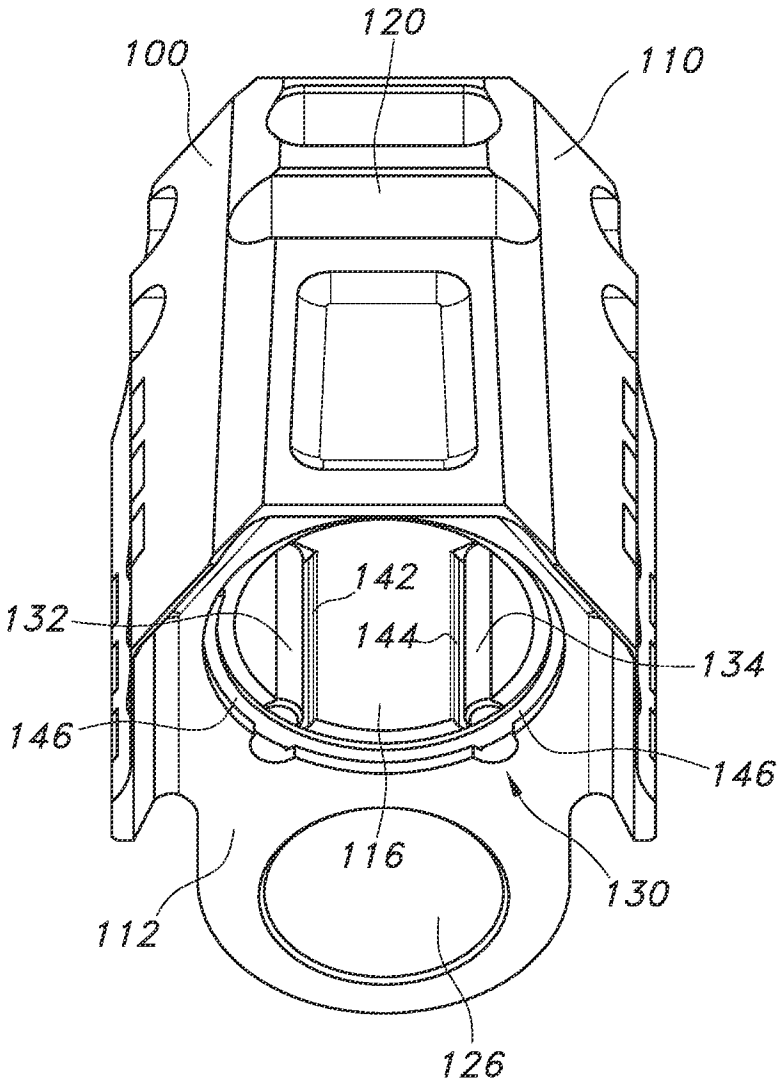
FIG. 7 is another rear view of the muzzle device shown in FIG. 3.

The threaded fastener 140 used to press each dowel pin 132, 134 against the muzzle 102 is a set screw. Each set screw 140 is positioned within a receiving hole 150 and comprises a hex socket drive, a thread, and a flat point. The receiving hole 150 for each set screw 140 perpendicularly traverses through the structural body 110 into one of the longitudinally extending grooves (136, 138). In this way, the point of the set screw 140 is aligned with the dowel pin 132, 134 nested within the longitudinally extending groove 136, 138. The receiving hole 150 for each set screw 140 is positioned so that the point of the set screw 150 presses against the lateral surface of a dowel pin (132, 134), the apex of the radius specifically, when threaded into position. However, in other embodiments, the receiving hole 150 for each set screw 140 is positioned so that the point of a set screw 150 presses against another portion of the dowel pin's (132, 134) lateral surface. Even though the muzzle device 100 is described with at least one set screw 140 per dowel pin (132, 134), preferably, the clamping mechanism 130 will utilize a pair of set screws with a pair of receiving holes for each dowel pin (132, 134) as shown in FIG. 6.

Figure 9:
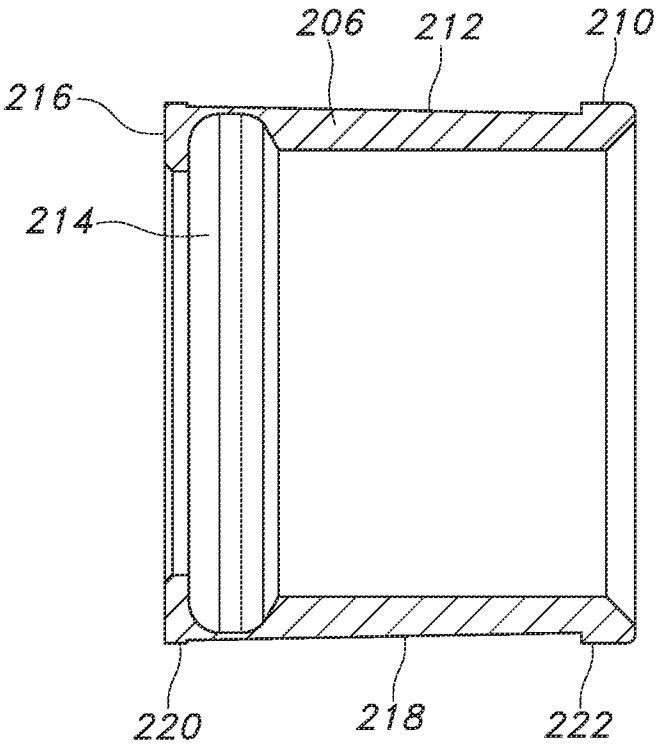
FIG. 9 is a side cutaway view of the thread protector shown in FIG. 8.
Figure 8:
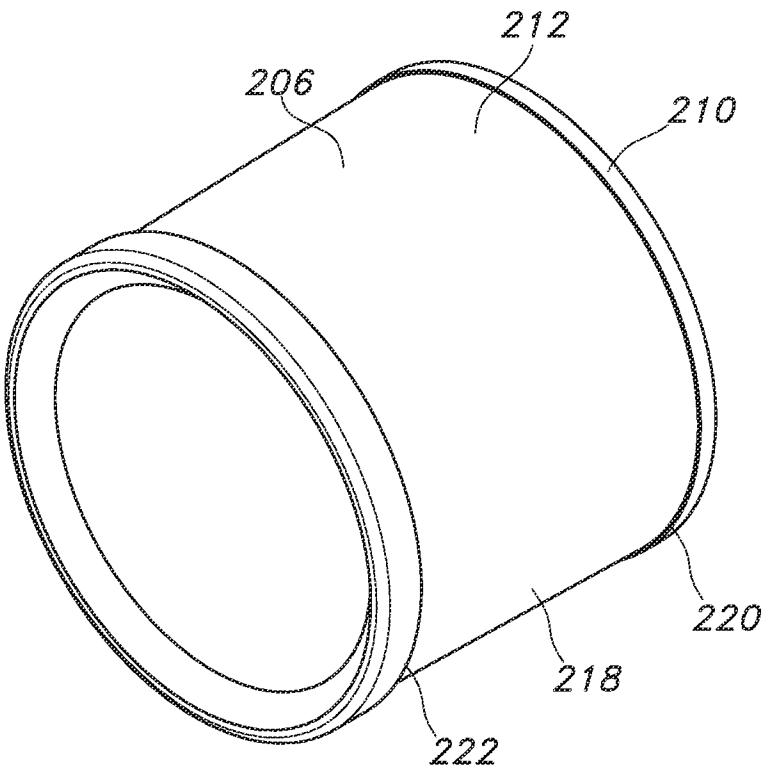
FIG. 8 is an isometric view of another example thread protector according to the principles of the present disclosure.
Figure 10:
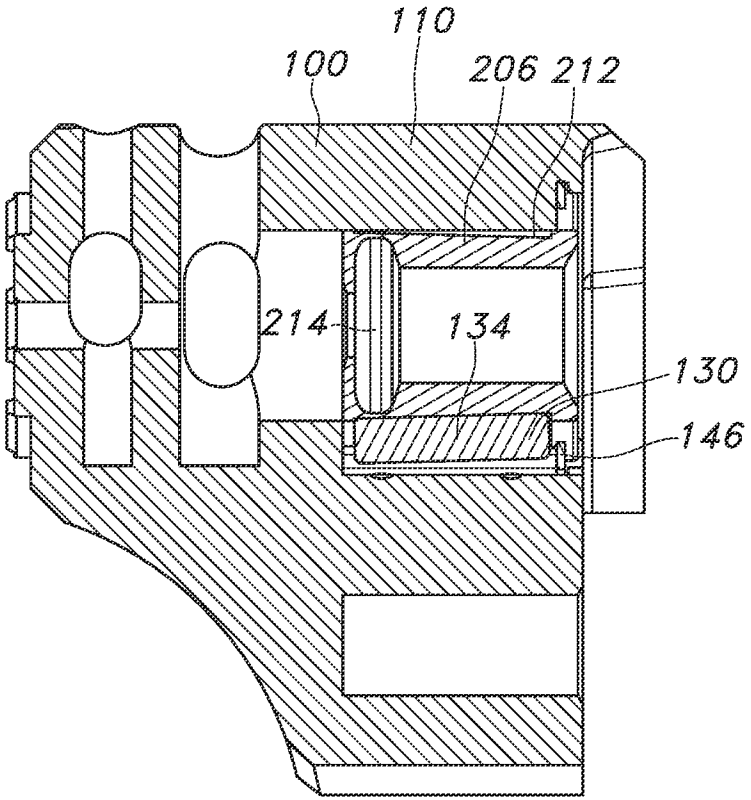
FIG. 10 is a side cutaway view of the muzzle device shown in FIG. 1 attached to the threaded protector shown in FIG. 8.

FIGS. 8 and 9 illustrate another example thread protector 206 according to the principles of the present disclosure. The thread protector 206 is similar to the thread protector 106 discussed above but includes a groove 212 in the exterior of the lateral surface 210 that is configured to serve as a mating interface for the clamping mechanism 130 of the muzzle device 100 (see, e.g., FIG. 10).

The thread protector 206, or bushing, is configured (e.g., dimensioned) to be received within the muzzle receiving aperture 116 of the structural body 110 and to threadedly engage the threads on the muzzle end of a barrel. An O-ring (not shown) can be positioned within a circumferential groove 214 located within the interior of and adjacent to the front end 216 of the thread protector 206. However, some embodiment of the thread protector 206 may not include the circumferential groove 214 for an O-ring. The groove 212 in the exterior of the lateral surface 210 is configured to receive therein a portion of each dowel pin (132, 134) extending from the longitudinally extending grooves (136, 138) in the muzzle receiving aperture 116 of the structural body 110 (see, e.g., FIG. 10).

The groove 212 is defined by a sloping surface 218 extending between two end walls (220, 222). Due to the sloping surface 218 of the groove 212, the clamping mechanism 130 is biased toward the slide 108 of the barrel 104 to which the muzzle device 100 is attached. The end walls (220, 222) of the groove 212 are configured (e.g., spaced) to receive therebetween, and act as bearing surfaces for, the portion of each dowel pin (132, 134) extending into the groove 212 of the thread protector 206. In this way, the end walls 220, 222 longitudinally locate the muzzle device 100 on the muzzle end of a barrel and prevent the muzzle device 100 from sliding back-and-forth. The portion of the lateral sidewall 210 that includes the groove 212 can resiliently deform when the clamping mechanism 130 is tightened thereon. In this way, the thread protector 206 may be prevented from rotating and thereby preserve the orientation of the muzzle device 100 attached thereto.

The groove 212 of the thread protector 206 could be machined onto the muzzle end of a barrel.

The structural body 110 of the muzzle device 100 is made of an aluminum alloy (e.g., 7075 aluminum), but could be made of another suitable material such as a titanium or steel alloy.

The dowel pins (132, 134) of the clamping mechanism 130 are made of a steel alloy, but could be made of another suitable material such as a brass alloy.

The thread protector 106, 206 is made of a steel alloy (e.g., 4140 steel), but could be made of an aluminum or brass alloy.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some embodiments" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A muzzle device configured for attachment to a muzzle of a firearm barrel, the muzzle device comprising:

a structural body comprising a first end that includes a muzzle-receiving aperture configured to fit about the muzzle of the firearm barrel, and a second end that includes a projectile aperture sized to allow the passage of a projectile exiting the muzzle of the firearm barrel; and a clamping mechanism comprising at least one dowel pin nested within a longitudinally extending groove in the muzzle-receiving aperture of the structural body, and a threaded fastener used to press the at least one dowel pin against the muzzle of the firearm barrel;

wherein the clamping mechanism is configured to allow both linear and axial positioning of the muzzle device on the muzzle of the firearm barrel.

2. The muzzle device of claim 1, wherein the longitudinally extending groove defines an exit opening having a width, and the at least one dowel pin is a cylindrical pin having an outside diameter greater than the width of the exit opening.

3. The muzzle device of claim 2, wherein the clamping mechanism further comprises: a retaining ring configured to capture the at least one dowel pin within the longitudinally extending groove, the retaining ring being positioned within a circumferential groove positioned about an entrance of the muzzle-receiving aperture.

4. The muzzle device of claim 1, wherein the at least one dowel pin has a lateral surface, and the threaded fastener is configured to press against the lateral surface of the at least one dowel pin.

5. The muzzle device of claim 1, wherein the clamping mechanism comprises:

two dowel pins nested within separate longitudinally extending grooves in the muzzle-receiving aperture of the structural body, and two threaded fasteners;

wherein one of the two threaded fasteners is used to press each of the two dowel pins against the muzzle of the firearm barrel.

6. The muzzle device of claim 5, wherein each of the longitudinally extending grooves defines an exit opening having a width, and each of the two dowel pins is a cylindrical pin having an outside diameter greater than the width of the exit opening.

7. The muzzle device of claim 6, wherein the clamping mechanism further comprises: a retaining ring configured to capture the two dowel pins within separate longitudinally extending grooves, the retaining ring being positioned within a circumferential groove positioned about an entrance of the muzzle-receiving aperture.

8. The muzzle device of claim 7, wherein each of the two dowel pins has a lateral surface, and one of the two threaded fasteners is configured to press against the lateral surface.

9. A muzzle device configured for attachment to a muzzle of a firearm barrel, the muzzle device comprising:

a structural body comprising a first end that includes a muzzle-receiving aperture configured to fit about the muzzle of the firearm barrel, and a second end that includes a projectile aperture sized to allow the passage of a projectile exiting the muzzle of the firearm barrel;

a thread protector with a groove in the exterior of its lateral surface, the thread protector is configured to fit within the muzzle-receiving aperture of the structural body and for attachment to the muzzle of the firearm barrel; and a clamping mechanism comprising at least one dowel pin nested within a longitudinally extending groove in the muzzle-receiving aperture of the structural body, and a threaded fastener used to press the at least one dowel pin into the groove of the thread protector;

wherein:

the groove of the thread protector is configured to serve as a mating interface for the clamping mechanism; and the clamping mechanism is configured to allow both linear and axial positioning of the muzzle device on the thread protector.

10. The muzzle device of claim 9, wherein the groove of the thread protector comprises a sloping surface extending between two end walls.

11. The muzzle device of claim 9, wherein the longitudinally extending groove defines an exit opening having a width, and the at least one dowel pin is a cylindrical pin having an outside diameter greater than the width of the exit opening.

12. The muzzle device of claim 11, wherein the clamping mechanism further comprises: a retaining ring configured to capture the at least one dowel pin within the longitudinally extending groove, the retaining ring being-positioned within a circumferential groove positioned about an entrance of the muzzle-receiving aperture.

13. The muzzle device of claim 9, wherein the at least one dowel pin has a lateral surface, and the threaded fastener is configured to press against the lateral surface of the at least one dowel pin.

14. The muzzle device of claim 9, wherein the clamping mechanism comprises:

two dowel pins nested within separate longitudinally extending grooves in the muzzle-receiving aperture of the structural body, and two threaded fasteners;

wherein one of the two threaded fasteners is used to press each of the two dowel pins into the groove of the thread protector.

15. The muzzle device of claim 14, wherein each of the longitudinally extending grooves defines an exit opening having a width, and each of the two dowel pins is a cylindrical pin having an outside diameter greater than the width of the exit opening.

16. The muzzle device of claim 15, wherein the clamping mechanism further comprises: a retaining ring configured to capture the two dowel pins within separate longitudinally extending grooves, the retaining ring being positioned within a circumferential groove positioned about an entrance of the muzzle-receiving aperture.

17. The muzzle device of claim 16, wherein each of the two dowel pins has a lateral surface, and one of the two threaded fasteners is configured to press against the lateral surface.

* * * * *